US008056640B2

(12) United States Patent
Kejr et al.

(10) Patent No.: US 8,056,640 B2
(45) Date of Patent: Nov. 15, 2011

(54) HYDRAULIC HEAD CLAMP ASSEMBLY FOR MOBILE DRILL RIG

(75) Inventors: Ryan J. Kejr, Salina, KS (US); Melvin Kejr, Salina, KS (US)

(73) Assignee: Kejr, Inc., Salina, KS (US)

( * ) Notice: Subject to any disclaimer, the term of this patent is extended or adjusted under 35 U.S.C. 154(b) by 296 days.

(21) Appl. No.: 12/465,429

(22) Filed: May 13, 2009

(65) Prior Publication Data

US 2009/0288882 A1 Nov. 26, 2009

Related U.S. Application Data

(60) Provisional application No. 61/055,346, filed on May 22, 2008.

(51) Int. Cl.
*E21B 19/10* (2006.01)
*E21B 19/16* (2006.01)

(52) U.S. Cl. ..... 166/382; 166/77.51; 173/74; 173/78

(58) Field of Classification Search ..... 166/77.51, 166/377, 380, 382; 175/85, 122, 162; 173/40, 173/41, 42, 141
See application file for complete search history.

(56) References Cited

U.S. PATENT DOCUMENTS 2,351,887 A * 6/1944 Steadman ..... 175/423
4,420,277 A * 12/1983 Hibbard et al. ..... 405/259.5
6,481,930 B2 * 11/2002 Forrest ..... 405/184

* cited by examiner

*Primary Examiner* — David Bagnell
*Assistant Examiner* — Richard Alker
(74) *Attorney, Agent, or Firm* — Jeffrey L. Thompson; Thompson & Thompson, P.A.

(57) ABSTRACT

A hydraulic head clamp assembly is integral with a drill head mounted on a mobile drill rig. A side-shift carriage is provided for shifting the drill head from side-to-side relative to a centerline of a drill rod string. The clamp assembly includes a rigid jaw mounted on the side of the drill head, and a movable jaw mounted adjacent to said rigid jaw with a space between the jaws for receiving the drill rod string. The movable jaw is connected to a pair of hydraulic cylinder actuators that are actuated via a hydraulic circuit to control the clamp action between the rigid jaw and the movable jaw. The clamp assembly can be used to retract a drill rod string from the ground without limiting access to the inner diameter of the drill rod, and can also be used to advance the drill rod into the ground via a static push.

14 Claims, 7 Drawing Sheets

Fig. 5
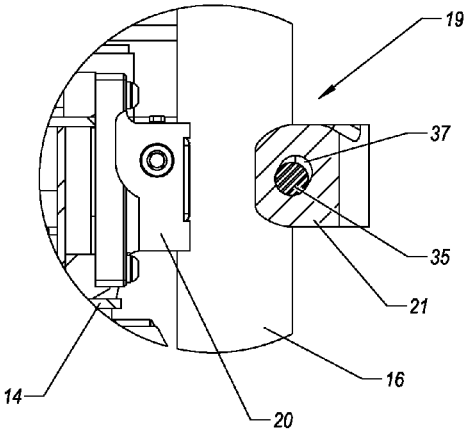
Fig. 6
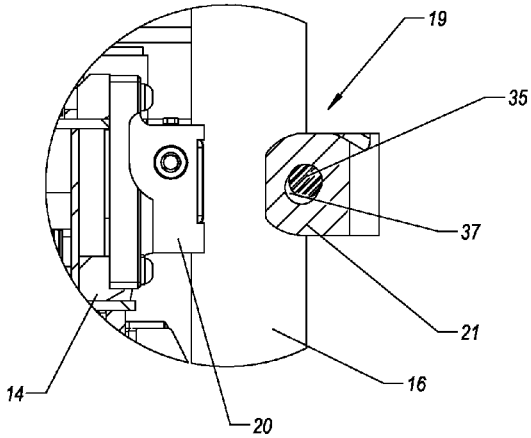
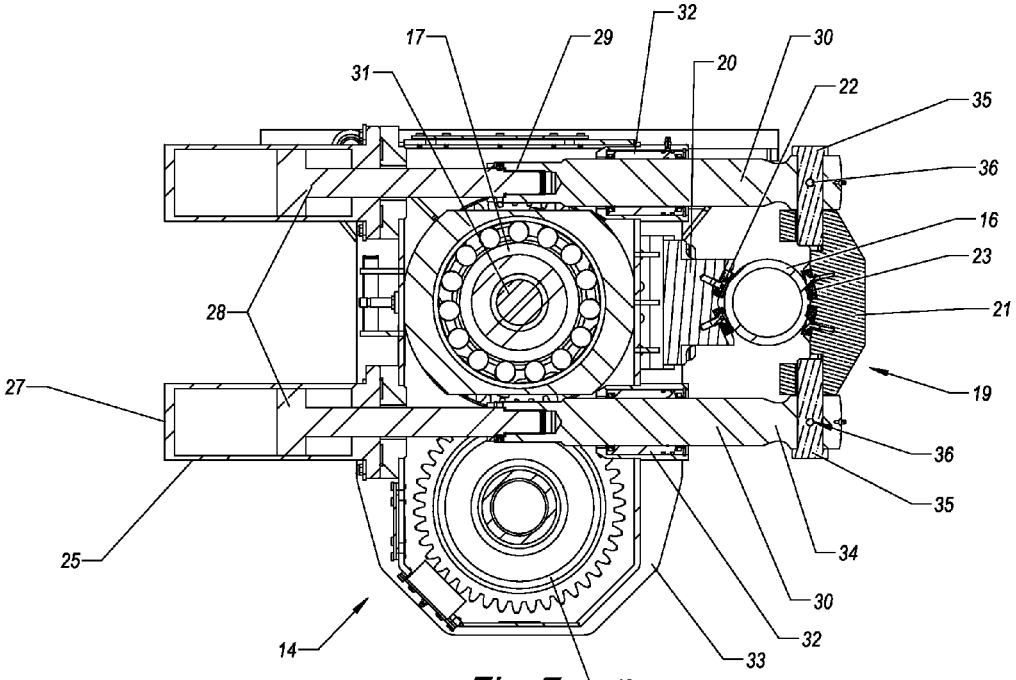
Fig. 7

HYDRAULIC HEAD CLAMP ASSEMBLY FOR MOBILE DRILL RIG

RELATED APPLICATIONS

This application claims priority of U.S. Provisional Application No. 61/055,346 filed on May 22, 2008. The content of this prior application is incorporated herein by reference.

BACKGROUND OF THE INVENTION

1. Field of the Invention

This invention relates generally to mobile drill rigs for advancing drill rods into the ground and retracting drill rods from the ground. In particular, the present invention relates to devices and methods for retracting a drill rod from the ground using a hydraulic clamp assembly carried on the drill head.

2. Description of the Related Art

A mobile drill rig can be used for many tasks, including: soil core and soil gas sampling, groundwater sampling and testing, geotechnical investigation, installing geothermal ground loops, contaminant logging, grouting, and materials injection. A typical drill rig includes a power unit, a drill mast, positioning features (e.g., movement fore and aft, tilt of the drill mast, outriggers, and so forth), drill head, and support hardware (e.g., pumps, winch, and so forth).

There are two conventional techniques for advancing tooling into the ground: drilling and direct push. When drilling, the subsurface material is brought to the surface. Typical drilling techniques are: augering, coring (e.g., core drill, sonic drilling), and cut and flush (e.g., air/mud rotary and down hole hammer). Instead of removing material, a direct push technique uses the static weight of the drill rig and, typically, a hydraulic hammer to displace the excess material into the surrounding formation.

Advancing the drill rod into the ground is only the first part of the procedure; the drill rod must be retracted from the ground as well. Historically, an operator was limited to the following methods of retracting the drill rod:

1. Thread onto the drill rod with the head spindle and use the head to pull back the drill rod. This method had the negative effects of wear on the threaded components and blocking access to the inner diameter of the rod while pulling.

2. Thread on a pull bail and use an overhead winch. This method had the negative effects of safety concerns and typically pulling over the drill rod centerline, making it difficult to access the inner diameter of the drill rod.

3. Upset top cap. This method had the negative effects of requiring threading on a cap, and typically blocking access to the inner diameter of the rod while pulling.

4. Upset on drill rod. This method had the negative effect of requiring the drill rod to be engaged and pulled only at specific height intervals.

5. Manual drill rod grip pull system. This method had the negative effect of a non-positive grip and being difficult to use with long drill rod lengths.

6. Casing jack. This method had the negative effect of being slow and typically having a limited stroke length.

There is a need in the industry for an improved device and technique for retracting drill rod strings from the ground.

BRIEF DESCRIPTION OF THE DRAWINGS

The present invention will become more clearly appreciated as the disclosure of the present invention is made with reference to the accompanying drawings. In the drawings:

FIG. 5 is an elevation view of the clamp assembly sectioned through the pin-jaw interface for showing the movable jaw shifted up and away in its slotted pin connection.

FIG. 6 is an elevation view of the clamp assembly sectioned through the pin-jaw interface for showing the movable jaw shifted down and in relative to its slotted pin connection.

FIG. 7 is a cross section plan view of the drill head with the drill rod positioned in the clamp assembly.

DETAILED DESCRIPTION OF THE INVENTION

A hydraulic head clamp assembly for a mobile drill rig according to the present invention will be described in detail with reference to FIGS. 1 to 10 of the accompanying drawings.

Figure 1:
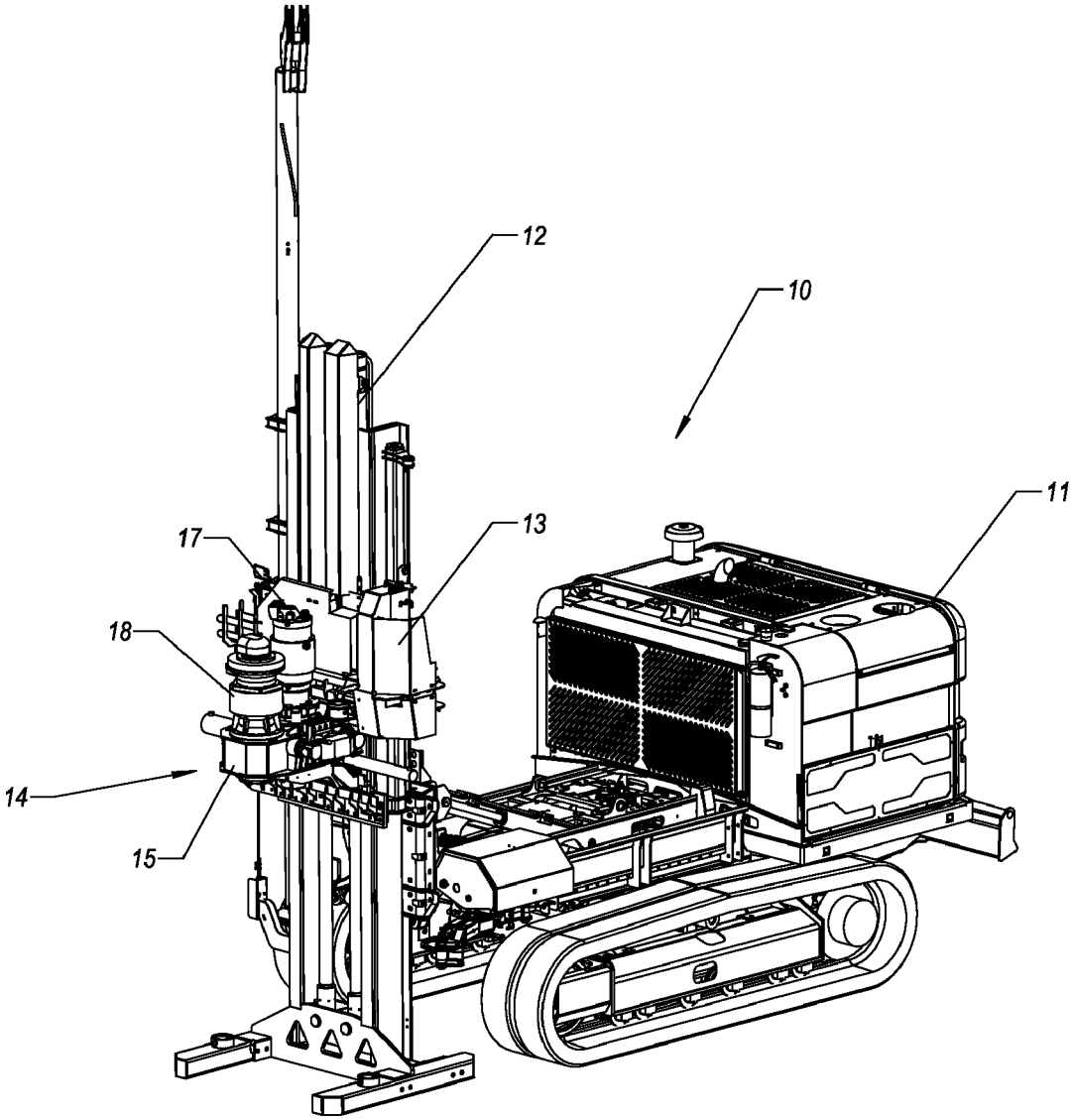
FIG. 1 is a perspective view of a mobile drill rig equipped with a drill head and integral hydraulic head clamp assembly according to the present invention.
Figure 2:
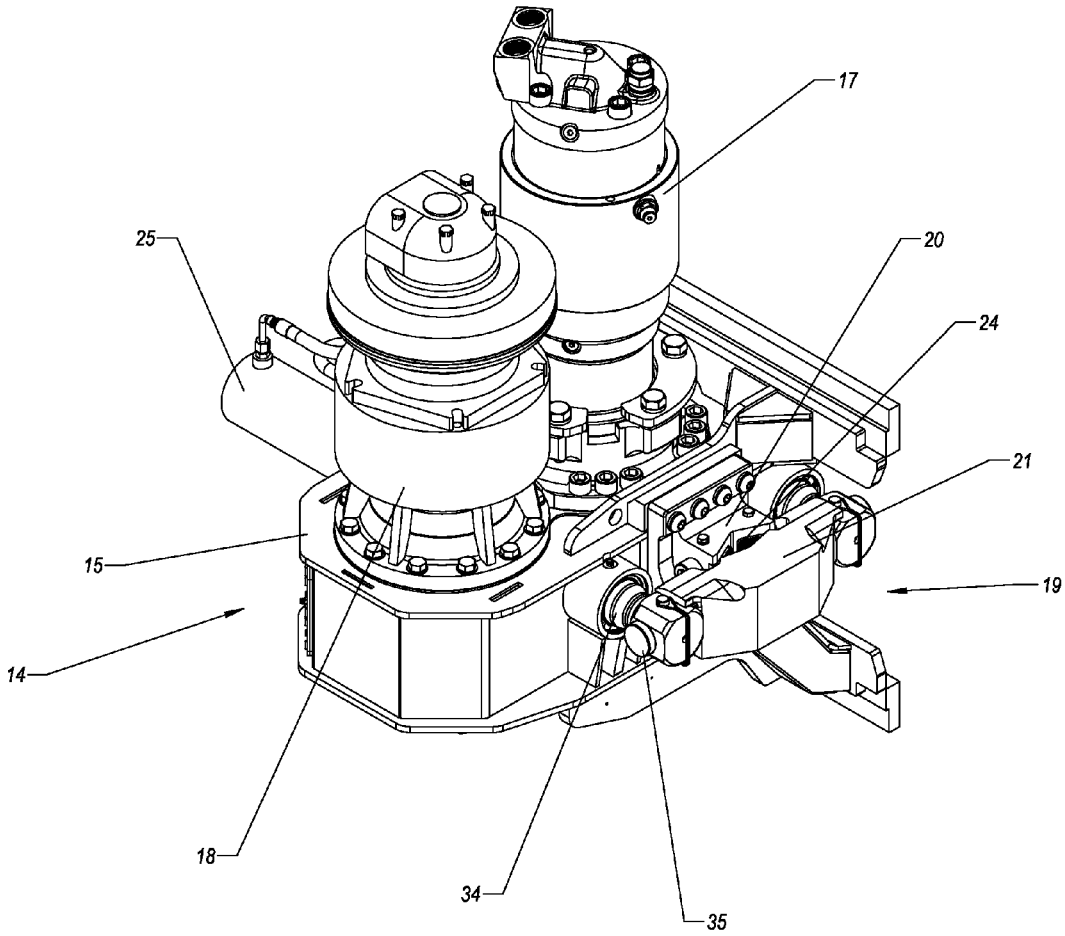
FIG. 2 is a perspective view of a drill head having an integral hydraulic head clamp assembly according to the present invention.
Figure 2A:
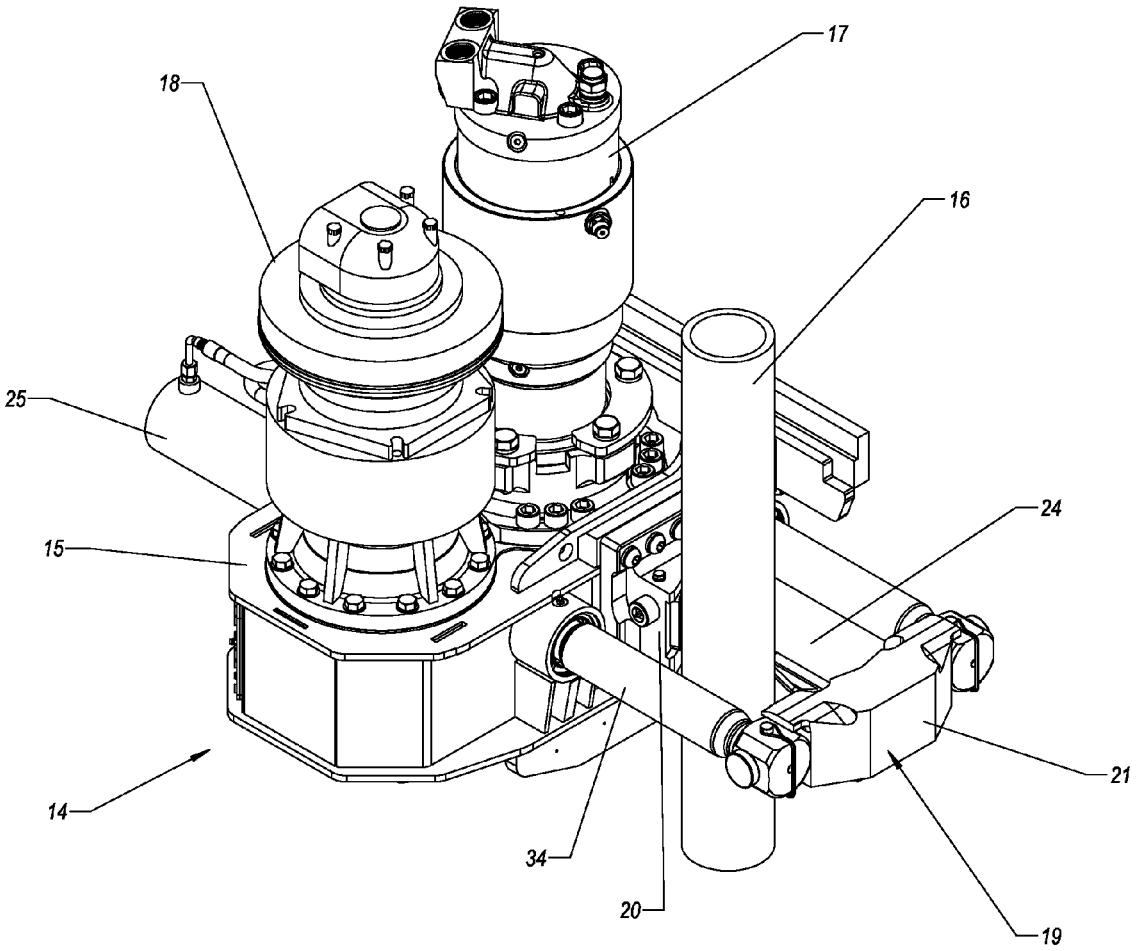
FIG. 2A is another perspective view of the drill head with the clamp assembly in an open position and a drill rod positioned between the jaws of the clamp assembly.
Figure 3:
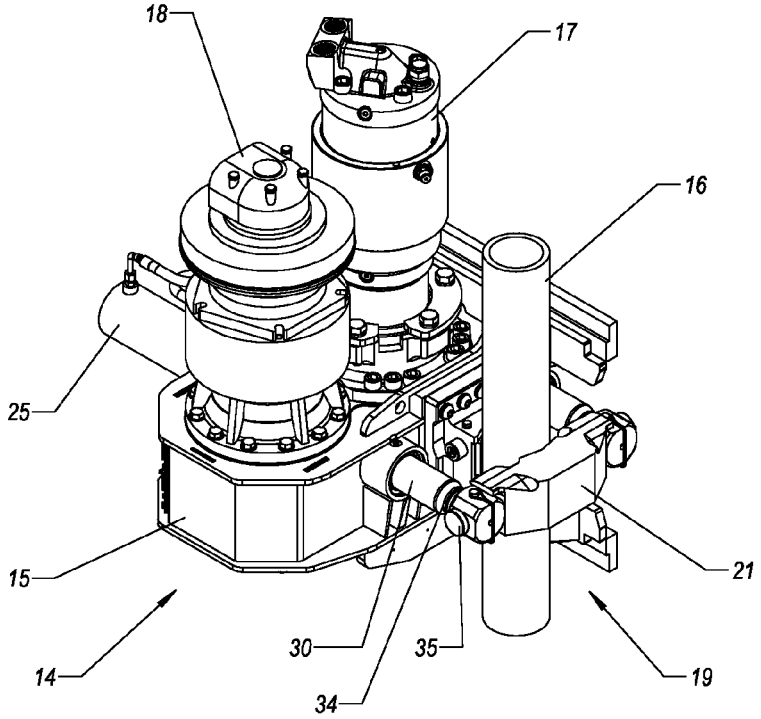
FIG. 3 is a perspective view of the drill head shown in FIG. 2A with the clamp assembly in a closed position for clamping against the outer surface of the drill rod.
Figure 4:
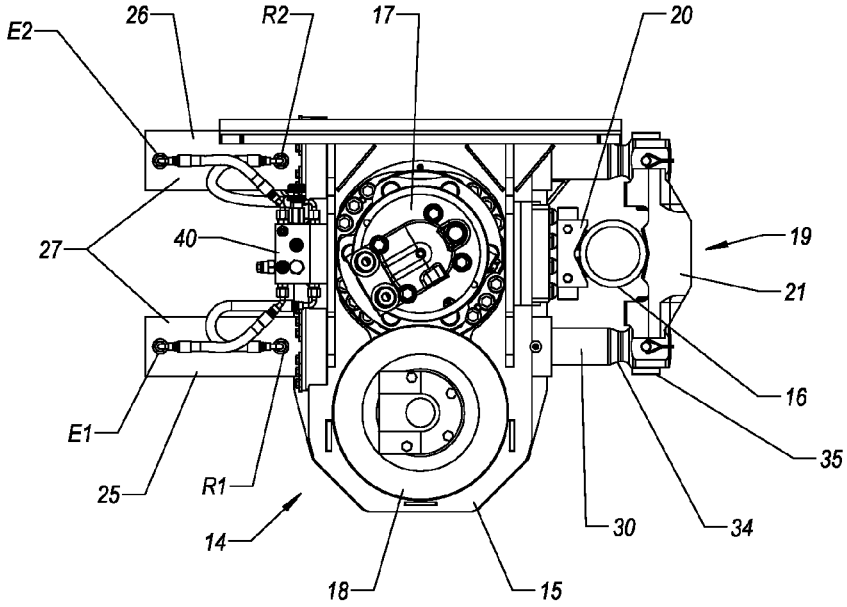
FIG. 4 is a plan view of the drill head with the clamp assembly in its closed position for clamping against the outer surface of the drill rod.
Figure 8:
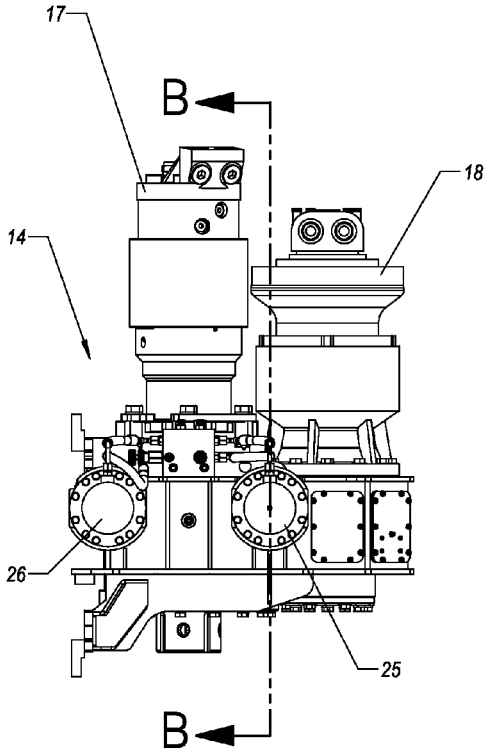
FIG. 8 is a side view of the drill head with an integral clamp assembly according to the present invention.
Figure 9:
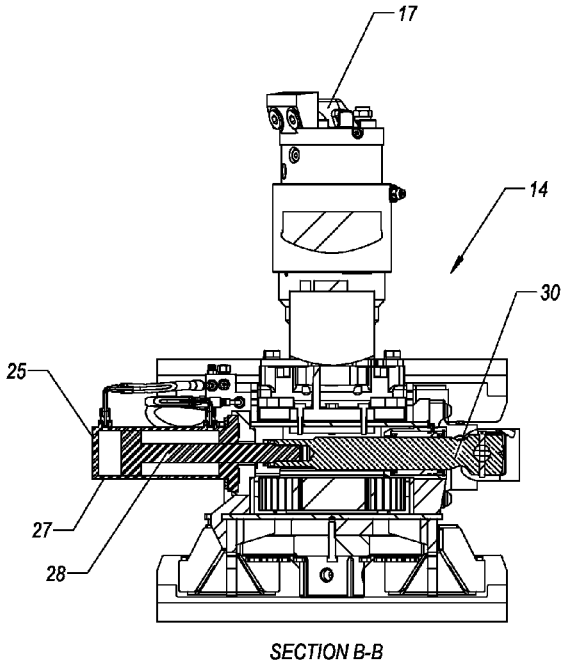
FIG. 9 is a cross section elevation view of the drill head with the integral clamp assembly, as viewed along line B-B in FIG. 8.

A mobile drill rig 10 for advancing tooling into the ground is shown in FIG. 1. The drill rig 10 includes a power unit 11, a drill mast 12, a mechanism for tilting the drill mast 12 and moving the mast fore and aft, and a carriage 13 mounted on the drill mast 12. The carriage 13 is slidable in a vertical direction along the drill mast 12, and is also slidable from side-to-side in a horizontal direction relative to the drill mast 12. Hydraulic actuators are provided to move the carriage 13 along the drill mast 12 and for sliding the carriage 13 from side-to-side in a known manner.

A drill head 14 is mounted on the carriage 13. The drill head 14 has a drive mechanism 15 for driving a plurality of drill rods 16 ("a drill string") into the ground in a known manner. For example, the drill head 14 can have a percussion hammer 17 for advancing the drill rod string 16 into the ground using a direct push technique. The drill head 14 can be positioned with the percussion hammer 17 directly over the drill rod string 16 for driving the drill rod string 16 into the ground. Alternatively, drive motor 18 could be used to rotate the drill rod string 16 using conventional rotary drilling techniques.

A clamp assembly 19 is integral with the drill head 14 for retracting the drill rod string 16 from the ground. The clamp assembly 19 includes a rigid jaw 20 mounted on a side of the drill head 14, and a movable jaw 21 mounted adjacent to and facing the rigid jaw 20. The rigid jaw 20 has a drill rod engaging surface 22 that faces outwardly from the side of the drill head 14, while the movable jaw 21 has a drill rod engaging surface 23 that generally faces inwardly toward the drill head 14. A space 24 is formed between the rigid jaw 20 and the movable jaw 21 for receiving the drill rod string 16 between the two jaws 20, 21. The space 24 between the jaws 20, 21 can be easily adjusted to accommodate a wide range of drill rod string sizes. The jaws 20, 21 are arranged to clamp on an outside surface of the drill rod string 16 while leaving an inside diameter of the drill rod string 16 open, and a top thread of the drill rod string 16 exposed.

First and second hydraulic cylinder actuators 25, 26 are provided for moving the movable jaw 21 toward the rigid jaw 20 to clamp the drill rod string 16 between the two jaws 20, 21. The hydraulic cylinder actuators 25, 26 each have a cylinder 27 and piston assembly 28 arranged for linear movement of the piston assembly 28 relative to the cylinder 27 in a horizontal direction. The piston assemblies 28 are each connected by threaded connections 29 to connecting rods 30 that extend horizontally through the drill head 14 on opposite sides of a center 31 of the percussion hammer 17. The rods 30 are supported at spaced locations along their lengths by bearings 32 or other suitable structures that allow the rods 30 to move linearly in a horizontal plane relative to the housing 33 of the drill head 14. The ends 34 of the rods 30 protrude outwardly from the side of the drill head 14 on respective sides of the rigid jaw 20.

The movable jaw 21 is connected at each of its ends by pin members 35 associated with the protruding ends 34 of the rods 30. The pin members 35 each extend in a direction perpendicular to the sliding direction of the rods 30 and protrude inwardly toward each other. The pin members 35 are anchored to the ends 34 of the rods 30 by a suitable fastener 36, such as a roll pin or the like.

The movable jaw 21 has elongated slots 37 formed at each end for receiving the pin members 35. The elongated slots 37 are inclined in a direction that causes the movable jaw 21 to increase its clamping force as an axial load applied to the rod string 16 increases. Specifically, as shown in FIG. 5, the pin members 35 are located at a lower inner end of the slot 37 when the jaws 20, 21 are first clamped on the rod string 16. The movable jaw 21 moves upwardly and outwardly along the inclined slots 37, as shown in FIG. 5. The cam action between the pin members 35 and the inclined slot 37 causes the movable jaw 21 to move downwardly and inwardly relative to the rigid jaw 20, thereby increasing the clamping force on the rod string 16 when an axial load is applied to the rod string 16, as shown in FIG. 6. This allows the initial clamping force prior to applying an axial load to the rod string 16 to be minimized to allow clamping of various strength drill rod, including thin-walled casing.

The rigid and movable jaws 20, 21 can each be provided with teeth or other suitable structures to enhance their grip on the outer surface of the drill rods 16. For example, a plurality of teeth that are angled slightly upwardly can be provided on the jaws 20, 21 to improve the grip and increase the amount of axial lifting force that can be imparted to the drill rod 16 by the clamping assembly 19.

Figure 10:
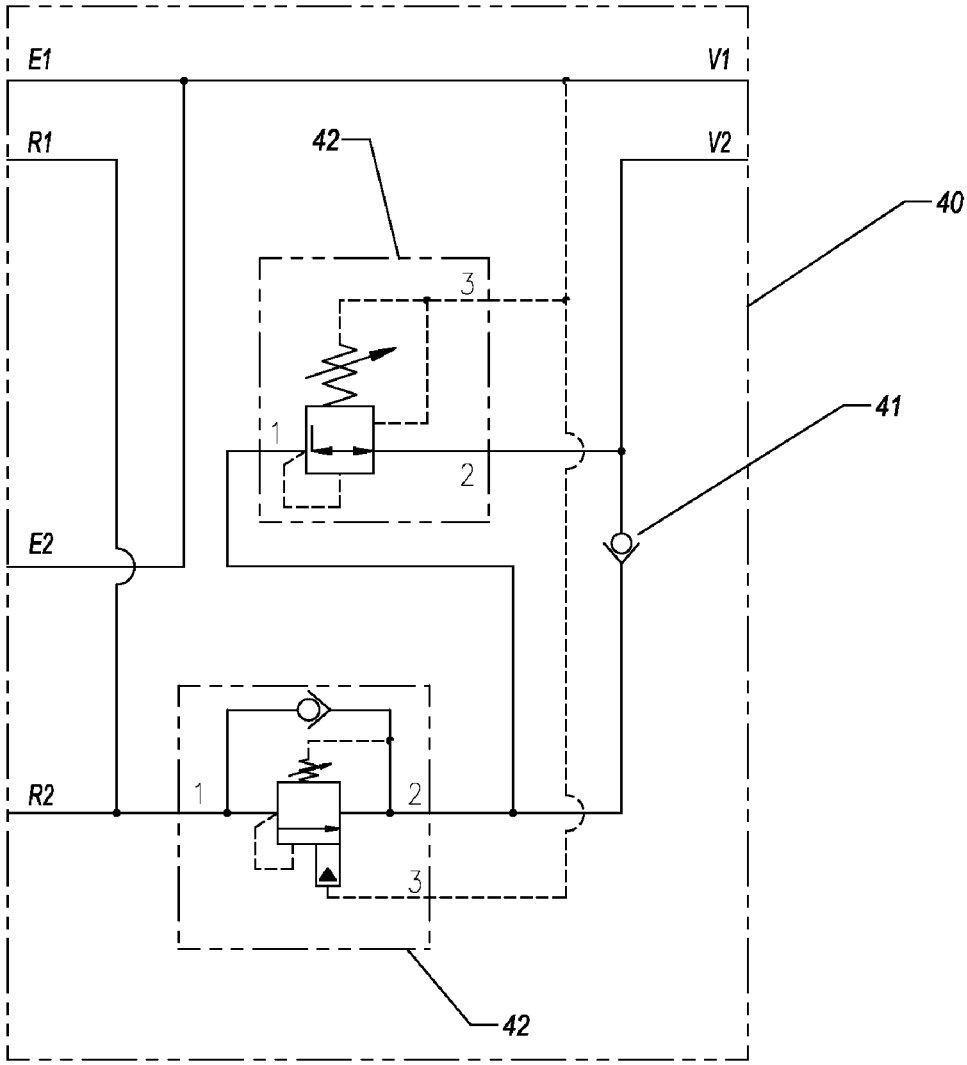
FIG. 10 is a schematic diagram of the hydraulic circuit used to control the hydraulic actuators for the clamp assembly.

A hydraulic control circuit 40 for controlling the first and second hydraulic actuators 25, 26 is shown in FIG. 10. The hydraulic control circuit 40 includes two supply/return oil lines V1 and V2, an arrangement of check valves 41 and pressure valves 42, and connection ports associated with the rod ends R1, R2 and butt ends El, E2 of each of the first and second hydraulic cylinder actuators. The check valves 41 and pressure valves 42 of the circuit 40 are arranged to provide a load lock feature for maintaining a positive clamping force on the movable jaw 21 until the operator causes an unclamping force to be applied.

In use, the drill head 14 can be moved horizontally between a first position, in which a centerline of the rod string 16 is vertically aligned with the percussion hammer 17 or other drive mechanism of the drill head 14, and a second position, in which the centerline of the drill rod string 16 is vertically aligned with the space 24 between the rigid jaw 20 and the movable jaw 21. The side-shift carriage 13 provides the mechanism for moving the drill head 14 between the first and second positions. With the drill head 14 in its first position, the drive mechanism can be used in a conventional manner to drive the rod string 16 into the ground.

When it is desired to retract the rod string 16 from the ground (or to lower the rod string 16 using the clamp assembly), the drill head is moved to its second position with the jaws of the clamp assembly 19 positioned over the rod string 16. The drill head 14 is then lowered until an outer surface of the drill rod string 16 is positioned between the jaws 20, 21 of the clamp assembly 19. The hydraulic cylinder actuators 25, 26 are then actuated to cause the movable jaw 21 to move toward the rigid jaw 20 to cause the jaws 20, 21 to clamp against the outer surface of the rod string 16. When the movable jaw 21 contacts the outer surface of the drill rod 16, the movable jaw 21 is forced upwardly and outwardly in the elongated slots 37 relative to the pin members 35, as shown in FIG. 5.

The drill head 14 can then be raised or lowered along the drill mast 12 to move the drill rod 16 in the desired upward or downward direction. If the drill head 14 is raised to retract the drill rod string 16 from the ground, an axial lifting force is applied to the drill rod string 16 by the jaws 20, 21 of the clamp assembly 19. The friction between the jaws 20, 21 and the drill rod 16 when the drill head 14 is raised forces the movable jaw 21 inwardly and downwardly in the elongated slots 37 relative to the pin members 35, as shown in FIG. 6, thereby increasing the clamp force on the drill rod 16

Upon moving the drill head 14 to a desired position, the hydraulic actuators 25, 26 can be actuated to open the clamp assembly 19, and the drill head 14 and clamp assembly 19 can be raised or lowered relative to the drill rod string 16. The hydraulic actuators 25, 26 can then be actuated again to cause the jaws 20, 21 to clamp against the outer surface of the drill rod string 16. This sequence can be repeated as necessary to provide a quick and efficient method of retracting the entire drill rod string 16 from the ground, or to reposition the drill rod string 16 to another desired height.

With the head clamp assembly 19 of the present invention, the inner diameter of the drill rod 16 can be kept open at the top with the top thread of the drill rod 16 exposed while retracting the drill rod string. This allows the operator to ensure that a well or sensor or the like stays at the proper depth while pulling back the casing; allows the casing to be worked separately from an internal drill rod string; and is typically quicker than alternative methods, especially when an overhead winch is used to handle the removed drill rod sections.

It will be understood by those skilled in the art that various modifications of the embodiment disclosed herein can be made without departing from the scope of the present invention. For example, the clamp assembly 19 disclosed herein can be used to perform functions other than raising and lowering the drill rod string 16. For example, the clamp assembly 19 can be used as a holder for auxiliary drive components, such as a high speed low torque drill motor for hard rock coring.

While the invention has been specifically described in connection with specific embodiments thereof, it is to be understood that this is by way of illustration and not of limitation, and the scope of the appended claims should be construed as broadly as the prior art will permit.

What is claimed is:

1. A hydraulic head clamp assembly for retracting a drill rod string, comprising:

a drill head adapted to be mounted on a mobile drill rig with a means for shifting the drill head from side-to-side in a horizontal direction and for raising and lowering the drill head in a vertical direction relative to the mobile drill rig;

a rigid jaw mounted on a side of the drill head;

a movable jaw mounted adjacent to said rigid jaw with a space between the jaws for receiving a drill rod string; and at least one hydraulic actuator for moving said movable jaw toward said rigid jaw to clamp the drill rod string between the rigid and movable jaws;

wherein said hydraulic actuator comprises first and second hydraulic cylinder actuators with respective rod ends connected to said movable jaw;

wherein said first and second hydraulic cylinder actuators each comprises a cylinder and piston assembly arranged for linear movement of the piston assembly relative to said cylinder in a horizontal direction; and wherein each of said piston assemblies comprises a rod that extends horizontally through the drill head on opposite sides of a centerline of a drive mechanism for driving the drill rod string into the ground, and said movable jaw is pin connected to the respective rod ends protruding from the side of the drill head.

2. The hydraulic head clamp assembly according to claim 1, wherein said rigid jaw and said movable jaw are arranged to clamp on an outside surface of a drill rod string for raising the drill rod string from the ground while leaving an inside diameter of the drill rod string open and a top thread of the drill rod string exposed.

3. The hydraulic head clamp assembly according to claim 1, wherein said hydraulic actuator provides a positive clamping and unclamping action on an outside surface of a drill rod string positioned between said movable and rigid jaws.

4. The hydraulic head clamp assembly according to claim 1, wherein said movable jaw and said rigid jaw are arranged to increase a clamping force on an outside surface of a rod string as an axial load applied to the rod string increases, whereby an initial clamp force prior to applying an axial load to the rod string can be minimized.

5. The hydraulic head clamp assembly according to claim 1, wherein the space between the movable jaw and the rigid jaw can be adjusted to accommodate a wide range of drill rod string sizes.

6. The hydraulic head clamp assembly according to claim 1, wherein said drill head is mounted on a drill mast of the mobile drill rig via a side-shift carriage that allows movement of the head clamp assembly over a centerline of the drill rod string without moving the drill mast.

7. The hydraulic head clamp assembly according to claim 6, wherein said side-shift carriage provides a means for moving the drill head horizontally between a first position in which the centerline of the drill rod string is vertically aligned with a percussion hammer on the drill head, and a second position in which the centerline of the drill rod string is vertically aligned with the space between the rigid jaw and the movable jaw.

8. The hydraulic head clamp assembly according to claim 1, further comprising a hydraulic control circuit for controlling said at least one hydraulic actuator, said control circuit having a load lock means for maintaining a positive clamping force between the movable jaw and the rigid jaw.

9. The hydraulic head clamp assembly according to claim 1, wherein said rods of said piston assemblies extend horizontally through the drill head on opposite sides of a centerline of a percussion hammer of said drive mechanism.

10. A hydraulic head clamp assembly for retracting a drill rod string, comprising:

a drill head adapted to be mounted on a mobile drill rig with a means for shifting the drill head from side-to-side in a horizontal direction and for raising and lowering the drill head in a vertical direction relative to the mobile drill rig;

a rigid jaw mounted on a side of the drill head;

a movable jaw mounted adjacent to said rigid jaw with a space between the jaws for receiving a drill rod string; and at least one hydraulic actuator for moving said movable jaw toward said rigid jaw to clamp the drill rod string between the rigid and movable jaws;

wherein said movable jaw is connected to the rod ends with slotted pin connections that cause the movable jaw to increase its clamping force as an axial load applied to the rod string increases.

11. The hydraulic head clamp assembly according to claim 10, wherein said slotted pin connections comprise elongated slots formed in the respective ends of the movable jaw for receiving connector pins that protrude from the respective rod ends of the hydraulic cylinder actuators, said elongated slots being inclined in a direction that causes said movable jaw to increase its clamping force as an axial load applied to the rod string increases.

12. A mobile drill rig comprising:

a drill mast;

a side-shift carriage mounted to said drill mast; and a drill head mounted on said side-shift carriage, said drill head having a drive mechanism for driving a rod string into the ground and a hydraulic head clamp for raising the rod string from the ground, said side-shift carriage being operable to move said drill head horizontally between a first position in which a centerline of the rod string is vertically aligned with the drive mechanism, and a second position in which the centerline of the rod string is vertically aligned with the hydraulic head clamp;

wherein said hydraulic head clamp comprises a rigid jaw mounted on a side of the drill head, a movable jaw mounted adjacent to said rigid jaw with a space between the jaws for receiving a drill rod string, and at least one hydraulic actuator for moving said movable jaw toward said rigid jaw to clamp the drill rod string between the rigid and movable jaws;

wherein said hydraulic actuator comprises first and second hydraulic cylinder actuators with respective rod ends connected to said movable jaw; and wherein said drive mechanism comprises a percussion hammer, wherein each of said hydraulic cylinder actuators comprises a rod that extends horizontally through the drill head on opposite sides of a vertical centerline of the percussion hammer with said rod ends protruding from the side of the drill head, and wherein said movable jaw is pin connected to the respective rod ends protruding from the side of the drill head.

13. A method of pulling a drill rod string from the ground, comprising:

moving a drill head from a first position, in which a centerline of a drill rod string is vertically aligned with a drive mechanism of the drill head, to a second position in which the centerline of the drill rod string is vertically aligned with a clamp assembly carried on the drill head;

lowering the drill head until an outer surface of the drill rod string is positioned between two opposed jaws of the clamp assembly;

actuating at least one hydraulic actuator to cause said two opposed jaws to clamp against the outer surface of the drill rod string; and raising the drill head along with the clamp assembly and the drill rod string with the drill rod string held within the clamp assembly by friction;

wherein said two opposed jaws of the clamp assembly comprise a rigid jaw attached to a side of the drill head and a movable jaw, and wherein said at least one hydraulic actuator comprises first and second hydraulic cylinder actuators with respective rod ends connected to said movable jaw;

wherein said first and second hydraulic cylinder actuators each comprises a cylinder and piston assembly arranged for linear movement of the piston assembly relative to said cylinder in a horizontal direction; and wherein each of said piston assemblies comprises a rod that extends horizontally through the drill head on opposite sides of a centerline of the drive mechanism for driving the drill rod string into the ground, and said movable jaw is pin connected to the respective rod ends protruding from the side of the drill head.

14. The method according to claim 13, further comprising actuating said at least one hydraulic actuator to open the clamp assembly, lowering the drill head and the clamp assembly relative to the drill rod string, and actuating said at least one hydraulic actuator to cause said two opposed jaws to again clamp against the outer surface of the drill rod string.

* * * * *